US012085092B2

(12) United States Patent
Xing et al.

(10) Patent No.: US 12,085,092 B2
(45) Date of Patent: Sep. 10, 2024

(54) AUXILIARY SHAFT SEAL FLUSHING SYSTEM OF A CENTRIFUGAL PUMP AND AN AXIAL FLOW PUMP

(71) Applicant: Tianyi Xing, Tianjin (CN)

(72) Inventors: Yu Xing, Tianjin (CN); Tianyi Xing, Tianjin (CN)

(73) Assignee: TIANJIN CRDT FLUID CONTROL SYSTEM LTD., Tianjin (CN)

( * ) Notice: Subject to any disclaimer, the term of this patent is extended or adjusted under 35 U.S.C. 154(b) by 0 days.

(21) Appl. No.: 15/519,299

(22) PCT Filed: Aug. 27, 2015

(86) PCT No.: PCT/CN2015/088224
§ 371 (c)(1),
(2) Date: Apr. 14, 2017

(87) PCT Pub. No.: WO2016/058452
PCT Pub. Date: Apr. 21, 2016

(65) Prior Publication Data

US 2017/0234332 A1 Aug. 17, 2017

(30) Foreign Application Priority Data

Oct. 15, 2014 (CN) ..... 201410542691.8
Feb. 16, 2015 (CN) ..... 201510053880.8

(51) Int. Cl.
*F04D 7/02* (2006.01)
*F04D 29/10* (2006.01)
*F04D 29/12* (2006.01)

(52) U.S. Cl.
CPC ..... *F04D 7/02* (2013.01); *F04D 29/108* (2013.01); *F04D 29/128* (2013.01)

(58) Field of Classification Search
CPC ..... F04D 7/02; F04D 29/108; F04D 29/128; F04D 15/0072; F16J 15/3404
See application file for complete search history.

(56) References Cited

U.S. PATENT DOCUMENTS 4,076,260 A 2/1978 Legoy et al.
4,082,297 A 4/1978 Adams
(Continued)

FOREIGN PATENT DOCUMENTS

CA 2398338 A1 8/2001
CN 101354044 A 1/2009
(Continued)

*Primary Examiner* — David E Sosnowski
*Assistant Examiner* — Jackson N Gillenwaters
(74) *Attorney, Agent, or Firm* — George G. Wang; Bei & Ocean

(57) ABSTRACT

An auxiliary shaft seal flushing system of a centrifugal pump and an axial flow pump, comprising a main running pump and a standby pump which are provided with a same shaft seal flushing system respectively, the shaft seal flushing system of the main running pump and that of the standby pump being connected in parallel to form a common shaft seal flushing system. The common shaft seal flushing system comprises: a first outlet pipe connected to an outlet of the main running pump and a first switch valve provided on the first outlet pipe for switching the flushing fluid, a second outlet pipe connected to an outlet of the standby pump and a second switch valve provided on the second outlet pipe for switching the flushing fluid, and a first fluid guide pipe connected to the outlets of the first outlet pipe and the second outlet pipe; the outlet of the first fluid guide pipe is respectively connected to a flushing fluid inlet on a sealing gland of the main running pump by a third outlet pipe and connected to a flushing fluid inlet on a sealing gland of the standby pump by a fourth outlet pipe. The present invention
(Continued)

can keep the parameters of the fluid material in sealed cavities of the main and standby pumps the same at all times.

5 Claims, 4 Drawing Sheets

(56) References Cited

U.S. PATENT DOCUMENTS

| | | | | |
|---|---|---|---|---|
| 4,998,861 | A | 3/1991 | Fukuzawa et al. | |
| 2005/0123395 | A1* | 6/2005 | Addie | F04D 29/128 415/172.1 |
| 2018/0180056 | A1* | 6/2018 | Zolotukhin | F04D 29/043 |

FOREIGN PATENT DOCUMENTS

| | | | | | |
|---|---|---|---|---|---|
| CN | 201297287 | Y | | 8/2009 | |
| CN | 201412382 | Y | | 2/2010 | |
| CN | 101354044 | B | * | 12/2010 | |
| CN | 101595306 | B | * | 5/2012 | F04D 29/126 |
| CN | 203257761 | U | | 10/2013 | |
| CN | 104791306 | A | | 7/2015 | |
| CN | 204532987 | U | | 8/2015 | |
| EP | 3805529 | A1 | * | 4/2021 | |
| WO | WO9854469 | A1 | | 12/1998 | |

* cited by examiner

AUXILIARY SHAFT SEAL FLUSHING SYSTEM OF A CENTRIFUGAL PUMP AND AN AXIAL FLOW PUMP

TECHNICAL FIELD OF THE INVENTION

The present invention relates to a shaft seal flushing system for pump, in particular to an auxiliary shaft seal flushing system of a centrifugal pump and an axial flow pump.

BACKGROUND OF THE INVENTION

A centrifugal pump in a chemical process plays an extremely important role in the fields of oil refining and chemical equipment. How to prolong the service life of the mechanical seal is an important subject of our current research. According to the Chapter 1.3 "Sealing performance requirements" of a standard flushing solution and auxiliary metal components of API682 appendix D (standard appendix), the seal should achieve the following requirements:

(1) The continuous service life of all seals is not less than 25000 hours;

(2) Under the condition of suppressing the pressure of the seal in a suppression sealed cavity being less than the leakage pressure [gage pressure is not more than 0.7 bar (10 psi)], the continuous service life is not less than 25000 hours; the continuous operation at least 8 hours when the main seal fails; and (3) According to the method 21 of EPA, the leakage of all seals should be controlled within 1000 ml/m$^3$ (1000 ppm vol), or according to a more stringent standards issued by certain local users, the continuous service life of the seal is not less than 25000 hours.

However, such performance requirements cannot be achieved in practical operation in most cases, there are many reasons affecting the continuous service life of the seal, in which we will focus on an extremely important reason affecting the continuous service life of the seal as below.

The entire large process flow of each oil refining and chemical industry comprises a lot of small and relatively independent processes, and the centrifugal pump as the important equipment is indispensable even in completion of a certain small process. The entire large process flow will be affected if one of the small processes goes wrong. In order to ensure the safety operation of the equipment, it is common to provide two pumps 1, 2 at positions where the centrifugal pumps required in each small process, and arrange the fluid inlets 21/22 and outlets 23/24 of the two pumps in parallel connection by pipelines. When in operation, one of the centrifugal pumps is in operation mode and the other one is standby, i.e., centrifugal pump 1 runs as a main pump, and the centrifugal pump 2 is always kept in good condition for standby. Once the centrifugal pump 1 breaks down, the centrifugal pump 2 is immediately switched into a main pump for operation, and the failure centrifugal pump 1 is to be repaired immediately, then turned into a standby pump after repaired and always kept in good condition, the centrifugal pump 2 then serves as a main pump to operate continuously so as to complete the process tasks of this small process. The centrifugal pumps 1, 2 are both provided in each small process of the entire large process flow, and switched back and forth to ensure that the entire large process flow keeping continuous operation in every moment.

However, it is not as simple as imagined in the actual chemical process. At present, the oil refining and chemical fields have entered deep processing and further developed to deeper processing, this means that the chemical residues are fewer and fewer, and the required process parameters are getting higher and higher accordingly. In this way, the properties and states of the material in flowing state or the stationary state conveyed in the same pump differ a lot. The material in the pump housing and the sealed cavity of the operating main pump are flowing, whereas the material in the standby pump is stationary. The reasons for the difference between them are as follows:

(1) Some materials are in the liquid state at high temperature and in the solid state at room temperature. The temperature of the whole flowing materials is uniform and kept in the fluid state; whereas the stopped material cannot keep a uniform temperature at everywhere at all times, so that part of the materials in the pump housing and the sealed cavity of the standby pump are in the solid state, and even all in the solid state. In the event of a sudden start of the standby pump occurs, it is quite possible to damage the mechanical seal. Even if the preheating cannot be done fully, because the preheating takes a long time and may affect the production.

(2) In order to keep the materials in the pump casing of the stopped standby pump in the fluid state at all times, it is necessary to carry out heat preservation and heat tracing to the standby pump. If such measures are adopted for a long time, a coking layer may be produced and attached to the stationary surface of the pump casing; the longer the pump is stopped, the thicker the coking layer is, and even the coking layer is carbonized and deteriorated, so that its properties are totally different from those of the actual materials, no matter how high the preheating temperature is, it can not turn back into the fluid state and may bond the rotating and stationary rings of the mechanical seal together. In the event of a sudden start of the standby pump occurs, it is quite possible to damage the mechanical seal.

(3) The materials conveyed by the pump may contain suspended particles, catalysts or other contamination particles. When flowing, the particles therein are suspended, and then precipitated due to the gravity thereof after the flowing stopped, so that a sediment layer is getting thicker and gradually hardened, resulting in the possibility of clogging the spring of the mechanical seal, holding and even boding the rotating ring and stationary ring of the mechanical seal. In this case, if a sudden start of the standby pump occurs, it is quite possible to damage the mechanical seal.

(4) The mechanical seal, valves and pipelines of the stopped standby pump is likely to appear extremely small leakage, the fluid levels of the materials in the pump casing and the sealed cavity are gradually reduced due to gravity. The space above the fluid level is filled with steam of the materials and part of gases such as the air, thereby exposing most of the volume of the friction pair of the mechanical seal to the gases. Because the air contains oxygen and the materials are likely to be flammable and explosive, at this point, when started the standby pump suddenly, the mechanical seal suddenly rotates at a high speed in the gas rather than in the fluid, and the friction heat generated by the friction pair cannot disperse in a short time, so that the combustion is extremely easy to incur. Such results ranges from immediately burning the mechanical seal, making the pump leaking, and stopping the pump for repairing to firing. This brings safety risks to the production.

(5) Because the materials in the pump casing and the sealed cavity of the standby pump which is stopped for a long time are precipitated on part of the surfaces of the parts; especially some solidified and even carbonated materials, which are precipitated on the auxiliary seal ring on an elastic compensation assembly of the mechanical seal and at a corresponding position of the shaft in contact therewith, are attached between the shaft and the seal ring to form a flange, resulting in hindering the normal operation of the compensation components and decreasing the follower ability. Furthermore, when the seal ring slightly moves on the shaft, it must jump over the flange each time, so that the friction between the seal ring and the flange is increased dramatically, thus damaging the seal ring to cause leakage.

Due to the above reasons, the risk of the seal leakage is always accompanied during switching the main pump and the standby pump, and the mechanical seal is most likely to be damaged. The best way is to make the performance parameters of the material in the sealed cavity of the standby pump in accordance with those of the material in the sealed cavity of the running main pump.

In the prior art, especially in the Chapter "standard flushing solution and auxiliary metal components" of the API 682 Appendix D (Standard Appendix), although a comprehensive seal flushing solution has been proposed, the seal flushing solutions thereof are all flushing solutions aiming at how to protect the running main pump (i.e., the centrifugal pump 1 in the drawings of the description), without a seal flushing solution for protecting the stopped standby pump 2.

SUMMARY OF THE PRESENT INVENTION

A technical problem to be solved by the present invention is to provide an auxiliary shaft seal flushing system of a centrifugal pump and an axial flow pump, which is capable of flushing a sealed cavity of a running main running pump and a sealed cavity of a stopped standby pump.

A technical solution employed by the present invention is as follows: an auxiliary shaft seal flushing system of a centrifugal pump and an axial flow pump, comprising a main running pump and a standby pump which are provided with a same shaft seal flushing system respectively, the shaft seal flushing system of the main running pump and that of the standby pump being communicated in parallel to form a common shaft seal flushing system.

The common shaft seal flushing system comprises: a first outlet pipe connected to an outlet of the main running pump and a first switch valve provided on the first outlet pipe for switching the flushing fluid, a second outlet pipe connected to an outlet of the standby pump and a second switch valve provided on the second outlet pipe for switching the flushing fluid, and a first fluid guide pipe connected to the outlets of the first outlet pipe and the second outlet pipe, wherein the outlet of the first fluid guide pipe is respectively connected to a flushing fluid inlet on a sealing gland of the main running pump via a third outlet pipe and connected to a flushing fluid inlet on a sealing gland of the standby pump via a fourth outlet pipe.

A coarse filter or an orifice plate is provided on the first fluid guide pipe.

A coarse filter and an orifice plate are provided on the first fluid guide pipe.

A first heat exchanger and a first temperature indicator are further provided on the first fluid guide pipe.

In another exemplary embodiment, the common shaft seal flushing system comprises: a first outlet pipe connected to an outlet of the main running pump and a first switch valve provided on the first outlet pipe for switching the flushing fluid, a second outlet pipe connected to an outlet of the standby pump and a second switch valve provided on the second outlet pipe for switching the flushing fluid, a hydrocyclone separator connected to the outlets of the first outlet pipe and the second outlet pipe, a second fluid guide pipe connected to a clean fluid outlet of the hydrocyclone separator and a third fluid guide pipe connected to a sewage outlet of the hydrocyclone separator, wherein an outlet of the second fluid guide pipe is respectively connected to a flushing fluid inlet on a sealing gland of the main running pump via a fifth outlet pipe and connected to a flushing fluid inlet on a sealing gland of the standby pump by a sixth outlet pipe, and the third fluid guide pipe is respectively connected to an inlet of the main running pump by a seventh outlet pipe and a third switch valve provided on the seventh outlet pipe, and connected to an inlet of the standby pump by an eighth outlet pipe and a fourth switch valve provided on the eighth outlet pipe.

A second heat exchanger and a second temperature indicator are further provided on the second fluid guide pipe.

An auxiliary shaft seal flushing system of a centrifugal pump and an axial flow pump of the present invention has the following beneficial effects:

1. Keeping the materials in the sealed cavity of the stopped standby pump in the fluid state and remaining the parameters of the fluid materials in the sealed cavities of the main and standby same at all times;
2. Avoiding generating a coking layer or a carbonization layer is from being attached to the surface of a stationary part of a pump casing, so as to avoiding bonding the rotating and stationary rings of the mechanical seal together;
3. Avoiding containing suspended particles, catalysts or other contamination particles in the materials conveyed by the pump; when the materials are flowing, the particles therein are suspended; by flushing, the present invention avoids the followings: the materials precipitated due to the gravity thereof when the flowing stopped, so that a sediment layer is getting thicker and gradually hardened, resulting in the possibility of clogging the spring of the mechanical seal, holding the rotating ring and stationary ring of the mechanical seal, and even bonding the rotating ring and stationary ring of the mechanical seal together;
4. Avoiding the possibility of extremely small leakage on the mechanical seal, valves and pipelines of the stopped standby pump when stopped for a long time; if leakage happens, the fluid levels of the material in the pump casing and the sealed cavity are gradually reduced due to gravity, the space above the fluid level is filled with steam of the materials and part of gases such as the air, thereby exposing most of the volume of a friction pair of the mechanical seal to the gases. Because the air contains oxygen, the material is likely to be flammable and explosive, at this point, when started the standby pump suddenly, the mechanical seal suddenly rotates at a high speed in the gas rather than in the fluid, and the friction heat generated by the friction pair cannot disperse in a short time, so that the combustion is extremely easy to incur. Such results ranges from immediately burning the mechanical seal, making the pump leaking, and stopping the pump for repairing to firing. This brings safety risks to the production;

5. Avoiding being precipitated on the exposed surfaces of the parts of the materials in the pump casing and the sealed cavity of the standby pump when stopped for a long time; especially some solidified and even carbonated materials, which are precipitated on the auxiliary seal ring on an elastic compensation assembly of the mechanical seal and at a corresponding position of the shaft in contact therewith, are attached between the shaft and the seal ring to form a flange, resulting in hindering the normal operation of the compensation components and decreasing the follower ability; furthermore, when the seal ring slightly moves on the shaft, it must jump over the flange each time, so that the friction between the seal ring and the flange is increased dramatically, thus damaging the seal ring to cause leakage and prolonging the service life of the mechanical seal.

In conclusion, the auxiliary shaft seal flushing system of a centrifugal pump and an axial flow pump of the present invention can keep the fluid material parameters in the sealed cavities of the main and standby pumps remaining same at all times, which not only reduces the risk of seal leakage of the standby pump when started or stopped, but also meets the requirements of "Chapter 1.3 sealing performance" in the API682 standard.

In which

1: Main running pump;
2: Standby pump;
3: First switch valve;
4: Second switch valve;
5: First outlet pipe;
6: Second outlet pipe;
7: First fluid guide pipe;
7-1: Coarse filter;
7-2: Orifice plate;
7-3: First heat exchanger;
7-4: First temperature indicator;
8: Third outlet pipe;
9: Fourth outlet pipe;
10: Sealing gland;
11: Sealing gland;
12: Second fluid guide pipe;
12-1: Second heat exchanger;
12-2: Second temperature indicator;
13: Hydrocyclone separator;
14: Third fluid guide pipe;
15: Seventh outlet pipe;
16: Third outlet pipe;
17: Eighth outlet pipe;
18: Fourth outlet pipe;
19: Fifth outlet pipe;
20: Sixth outlet pipe;
21: Inlet;
22: Inlet;
23: Outlet;
24: Outlet;
25: Pump shaft;
26: Pump shaft.

DETAILED DESCRIPTION OF THE PRESENT INVENTION

An auxiliary shaft seal flushing system of a centrifugal pump and an axial flow pump of the present invention will be further described in detail with reference to the accompanying drawings and the embodiments.

Figure 1:
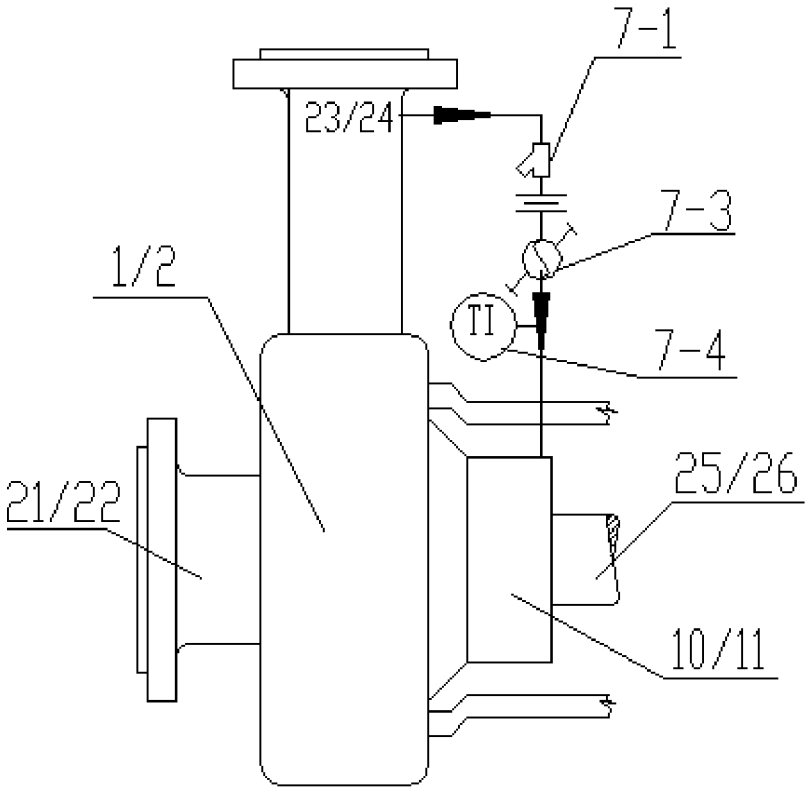
FIG. 1 is an overall structure diagram of a shaft seal flushing system of a centrifugal pump and an axial flow pump according to a first embodiment of the prior art.
Figure 2:
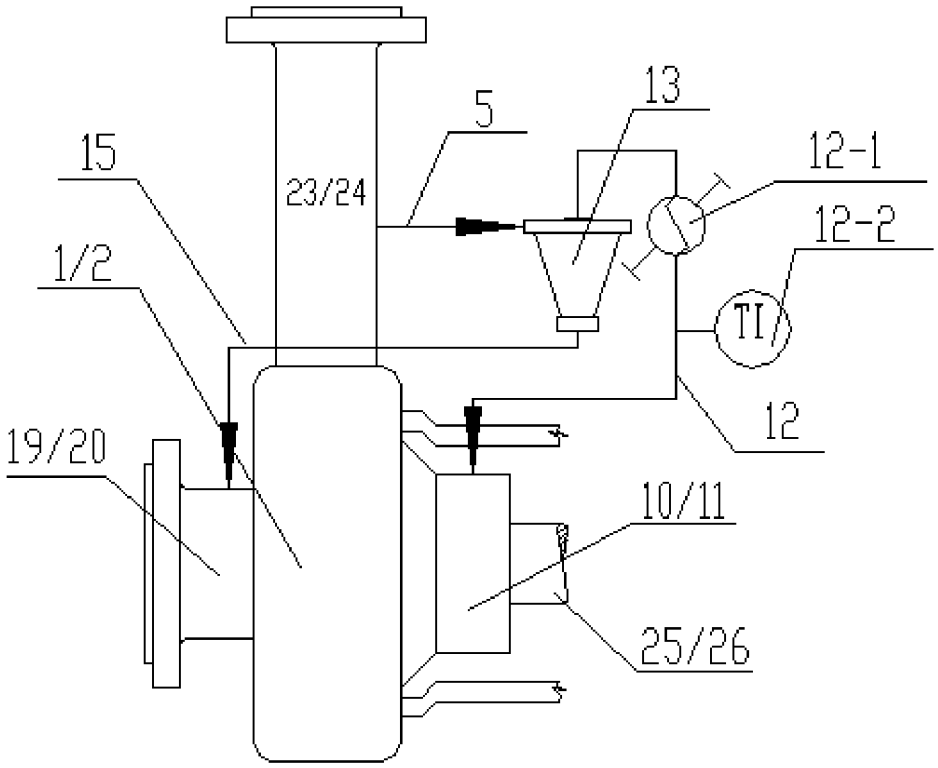
FIG. 2 is an overall structure diagram of a shaft seal flushing system of a centrifugal pump and an axial flow pump according to a second embodiment of the prior art.
Figure 3:
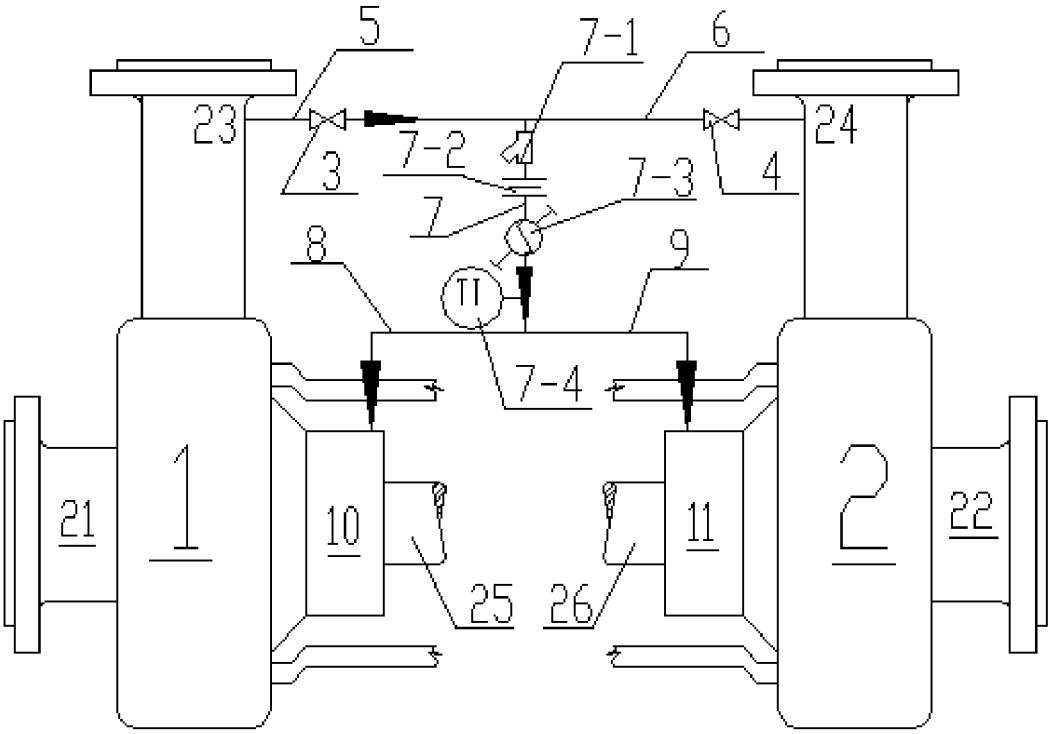
FIG. 3 is an overall structure diagram of a shaft seal flushing system of a centrifugal pump and an axial flow pump according to a first embodiment of the present invention.
Figure 4:
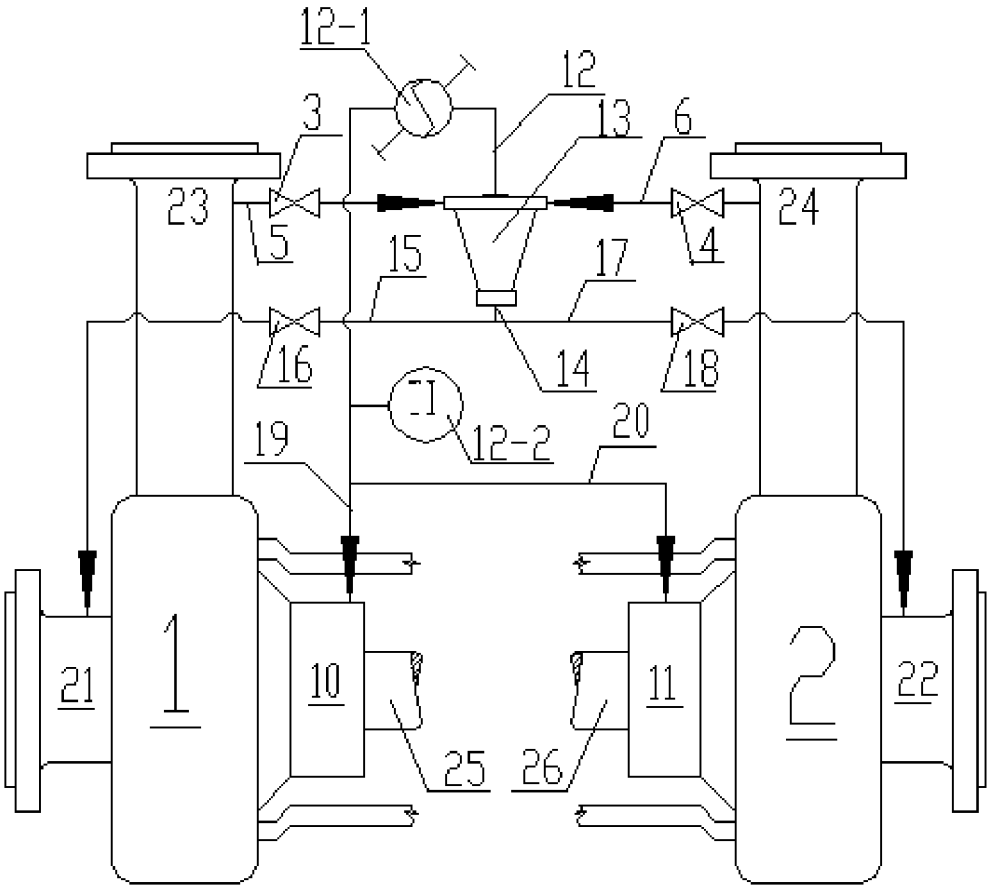
FIG. 4 is an overall structure diagram of an auxiliary shaft seal flushing system of a centrifugal pump and an axial flow pump according to a second embodiment of the present invention.

An auxiliary shaft seal flushing system of a centrifugal pump and an axial flow pump of the present invention is achieved on the basis of the prior art as shown in FIG. 1 and FIG. 2, and achieved by connecting the flushing system of the main running system and that of the standby pump in parallel. The auxiliary shaft seal flushing system of a centrifugal pump and an axial flow pump of the present invention, as shown in FIG. 3 and FIG. 4, comprises a main running pump 1 and a standby pump 2 which are provided with a same shaft seal flushing system respectively, the shaft seal flushing system of the main running pump 1 and that of the standby pump 2 are connected in parallel to form a common shaft seal flushing system. Namely, in the chapter "standard flushing solution and auxiliary metal components" of the API 682 Appendix D (Standard Appendix), a bypass pipeline is connected with an auxiliary system pipeline of a high pressure outlet 23 of the running main running pump 1, and the other end of the bypass pipeline is connected with the corresponding position of the flushing fluid inlet on a sealing gland 11 of the currently stopped standby pump 2, so that the seal flushing system achieves the purpose of flushing the seal of the running main running pump 1 while flushing the seal of the currently stopped standby pump 2 simultaneously. Henceforth, the stopped standby pump is always kept in good condition without any risk of the seal leakage when started the standby pump, thus making the great contribution to the commitment of continuous serving the seal no less than 25000 hours.

In the auxiliary shaft seal flushing system of a centrifugal pump and an axial flow pump of the present invention, when the running fluid flowing in the main running pump 1 is the flushing fluid without particles, as shown in FIG. 3, the common shaft seal flushing system comprises: a first outlet pipe 5 connected to an outlet 23 of the main running pump 1 and a first switch valve 3 provided on the first outlet pipe 5 for switching the flushing fluid, a second outlet pipe 6 connected to an outlet 24 of the standby pump 2 and a second switch valve 4 provided on the second outlet pipe 6 for switching the flushing fluid, and a first fluid guide pipe 7 connected to the outlets of the first outlet pipe 5 and the second outlet pipe 6, wherein an outlet of the first fluid guide pipe 7 is respectively connected to a flushing fluid inlet on a sealing gland 10 of the main running pump 1 by a third outlet pipe 8 and connected to a flushing fluid inlet on a sealing gland 11 of the standby pump 2 by a fourth outlet pipe 9.

When the pressure difference between the pressure at the outlets 23, 24 of the main running pump 1 and the standby pump 2 and that at the inlets 21, 22 thereof is more than 0.3 MPa, the first fluid guide pipe 7 is provided with an orifice plate 7-2 for controlling the pressure difference between them. If there are a small amount of suspended particles with large particle size in the first fluid guide pipe 7, a coarse filter 7-1 can also be provided in the first fluid guide pipe 7.

Alternatively, the coarse filter 7-1 and the orifice plate 7-2 are all provided on the first fluid guide pipe 7.

When the temperature of the flushing fluid in the first fluid guide pipe 7 is required to be controlled, a first heat exchanger 7-3 and a first temperature indicator 7-4 can also be provided on the first fluid guide pipe.

The operation process of the auxiliary shaft seal flushing system of a centrifugal pump and an axial flow pump of the present invention is as follows: when the main running pump 1 is in operation, the first switch valve 3 is opened and the second switch valve 4 is closed, the flushing fluid flows out from the outlet 23 of the main running pump 1 and then enters into the flushing fluid inlet on the sealing gland 10 of the main running pump 1 after successively passed through the first outlet pipe 5, the first switch valve 3, the first fluid guide pipe 7 and the fourth outlet pipe 9, the fluid enters into the mechanical sealed cavity and approaches to an end of the friction pair for flushing, and then enters into the main running pump 1 after passed through the mechanical sealed cavity. Meanwhile, the flushing fluid flows out from the outlet 23 of the main running pump 1 and then enters into the flushing fluid inlet on the sealing gland 11 of the standby pump 2 after successively passed through the first outlet pipe 5, the first switch valve 3, the first fluid guide pipe 7 and the third outlet pipe 9, the fluid enters into the mechanical sealed cavity and approaches to an end of the friction pair for flushing, and then enters into the standby pump 2 after passed through the mechanical sealed cavity.

In the above operation process, the main running pump 1 and the standby pump 2 can be used interchangeably, i.e., the standby pump 2 serves as a main running pump while the main running pump 1 serves as a standby pump, and the operation process is as mentioned above.

In another exemplary embodiment of the auxiliary shaft seal flushing system of a centrifugal pump and an axial flow pump of the present invention, when the flushing fluid flowing in the main running pump 1 contains suspended particles with high density, the common shaft seal flushing system as shown in FIG. 4 comprises: a first outlet pipe 5 connected to an outlet 23 of the main running pump 1 and a first switch valve 3 provided on the first outlet pipe 5 for switching the flushing fluid, a second outlet pipe 6 connected to an outlet 24 of the standby pump 2 and a second switch valve 4 provided on the second outlet pipe 6 for switching the flushing fluid, a hydrocyclone separator 13 connected to the outlets of the first outlet pipe 5 and the second outlet pipe 6, a second fluid guide pipe 12 connected to a clean fluid outlet of the hydrocyclone separator 13 and a third fluid guide pipe 14 connected to a sewage outlet of the hydrocyclone separator 13, wherein an outlet of the second fluid guide pipe 12 is respectively connected to a flushing fluid inlet on a sealing gland 10 of the main running pump 1 by a fifth outlet pipe 19 and connected to a flushing fluid inlet on a sealing gland 11 of the standby pump 2 by a sixth outlet pipe 20, and the third fluid guide pipe 14 is respectively connected to an inlet 21 of the main running pump 1 by a seventh outlet pipe 15 and a third switch valve 16 provided on the seventh outlet pipe 15, and connected to an inlet 22 of the standby pump 2 by an eighth outlet pipe 17 and a fourth switch valve 18 provided on the eighth outlet pipe 17. When the temperature of the flushing fluid in the second fluid guide pipe 12 is required to be controlled, a second heat exchanger 12-1 and a second temperature indicator 12-2 can also be provided on the second fluid guide pipe.

The operation process of the above auxiliary shaft seal flushing system of a centrifugal pump and an axial flow pump of the present invention is as follows: when the main running pump 1 is in operation, the first switch valve 3 and the third switch valve 16 are opened and the second switch valve 4 and the fourth switch valve 18 are closed, the flushing fluid flows out from the outlet 23 of the main running pump 1 and then enters into the hydrocyclone separator 13 after successively passed through the first outlet pipe 5 and the first switch valve 3 for separation, and the separated clean fluid without large particles enters into the flushing fluid inlet on the sealing gland 10 of the main running pump 1 after successively passed through the second fluid guide pipe 12 and the fifth outlet pipe 19; the fluid enters into the mechanical sealed cavity and approaches to an end of the friction pair for flushing, and then enters into the main running pump 1 after passed through the mechanical sealed cavity. Meanwhile the separated flushing fluid enters into the flushing fluid inlet on the sealing gland 11 of the standby pump 2 after successively passed through the second fluid guide pipe 12 and the sixth outlet pipe 20, the fluid enters into the mechanical sealed cavity and approaches to an end of the friction pair for flushing, and then enters into the standby pump 2 after passed through the mechanical sealed cavity. The separated sewage fluid containing a large amount of suspended particles with high density flows back to the inlet 21 of the main running pump 1 through the third fluid guide pipe 14.

In the above operation process, the main running pump 1 and the standby pump 2 can be used interchangeably, i.e., the standby pump 2 serves as a main running pump while the main running pump 1 serves as a standby pump, and the operation process is as mentioned above.

What is claimed is:

1. An auxiliary shaft seal flushing system of a centrifugal pump and an axial flow pump, comprising a main running pump (1) and a standby pump (2) which are provided with a same shaft seal flushing system respectively, wherein the shaft seal flushing system of the main running pump (1) and that of the standby pump (2) being communicated in parallel to form a common shaft seal flushing system, wherein the common shaft seal flushing system comprises: a first outlet pipe (5) connected to an outlet (23) of the main running pump (1) and a first switch valve (3) provided on the first outlet pipe (5) for switching the flushing fluid, a second outlet pipe (6) connected to an outlet (24) of the standby pump (2) and a second switch valve (4) provided on the second outlet pipe (6) for switching the flushing fluid, and a first fluid guide pipe (7) connected to outlets of the first outlet pipe (5) and the second outlet pipe (6); an outlet of the first fluid guide pipe (7) is respectively connected to a flushing fluid inlet on a sealing gland (10) of the main running pump (1) by a third outlet pipe (8) and connected to a flushing fluid inlet on a sealing gland (11) of the standby pump (2) by a fourth outlet pipe (9).

2. The auxiliary shaft seal flushing system of a centrifugal pump and an axial flow pump according to claim 1, wherein a coarse filter (7-1) or an orifice plate (7-2) is provided on the first fluid guide pipe (7).

3. The auxiliary shaft seal flushing system of a centrifugal pump and an axial flow pump according to claim 1, wherein a first heat exchanger (7-3) and a first temperature indicator (7-4) are further provided on the first fluid guide pipe (7).

4. The auxiliary shaft seal flushing system of a centrifugal pump and an axial flow pump according to claim 3, wherein a second heat exchanger (12-1) and a second temperature indicator (12-2) are provided on a second fluid guide pipe (12).

5. The auxiliary shaft seal flushing system of a centrifugal pump and an axial flow pump according to claim 2, wherein a first heat exchanger (7-3) and a first temperature indicator (7-4) are further provided on the first fluid guide pipe (7).

* * * * *